US005344153A

United States Patent [19]

Watanabe

[11] Patent Number: 5,344,153

[45] Date of Patent: Sep. 6, 1994

[54] BOARD GAME

[76] Inventor: Sadatoshi Watanabe, No. 26-5, Tokiwadaira 7-chome, Matsudo-shi, Chiba, Japan

[21] Appl. No.: 924,786

[22] Filed: Aug. 5, 1992

Related U.S. Application Data

[63] Continuation of Ser. No. 629,955, Dec. 19, 1990, abandoned.

[51] Int. Cl.[5] ..... A63F 3/00

[52] U.S. Cl. ..... 273/271; 273/261; 273/267; 273/282.1

[58] Field of Search ..... 273/236, 260, 261, 262, 273/263, 264, 265, 266, 267, 268, 272, 273, 282, 299

[56] References Cited

U.S. PATENT DOCUMENTS

| | | | |
|---|---|---|---|
| 1,704,819 | 3/1929 | Beaman | 273/261 |
| 3,152,806 | 10/1964 | Jackman | 273/272 |
| 3,887,190 | 6/1975 | Ameri | 273/291 |
| 4,221,387 | 9/1980 | Carter | 273/236 |
| 4,331,333 | 5/1982 | Willcocks | 273/272 |
| 4,515,370 | 5/1985 | Garcia | 273/261 X |
| 4,555,116 | 11/1985 | Fields | 273/236 |
| 4,739,992 | 4/1988 | May | 273/291 X |
| 4,940,241 | 7/1990 | Faraci | 273/261 |
| 5,014,995 | 5/1991 | Woodward | 273/261 |
| 5,209,488 | 5/1993 | Kimball | 273/261 |

OTHER PUBLICATIONS

"Go", The Way to Play, by the Diagram Group Paddington Press Ltd., 1975, pp. 54–56.

*Primary Examiner*—Vincent Millin
*Assistant Examiner*—William M. Pierce
*Attorney, Agent, or Firm*—Lowe, Price, LeBlanc & Becker

[57] ABSTRACT

A board game comprises a game board in which a plurality of triangular spaces are defined, within the interior of a hexagon defined by three pairs of parallel sides, by a plurality of straight lines equidistantly spaced from each other and extending in parallel to the three pairs of parallel sides of the hexagon. A central space located substantially at the center of the hexagon and three spaces located immediately adjacent thereto are different in appearance from all the other spaces. The game further comprises at least three sets of pluralities of small play pieces sized and shaped to rest respectively on the individual spaces of the game board. The at least three sets are different in appearance from each other.

9 Claims, 8 Drawing Sheets

FIG. 2
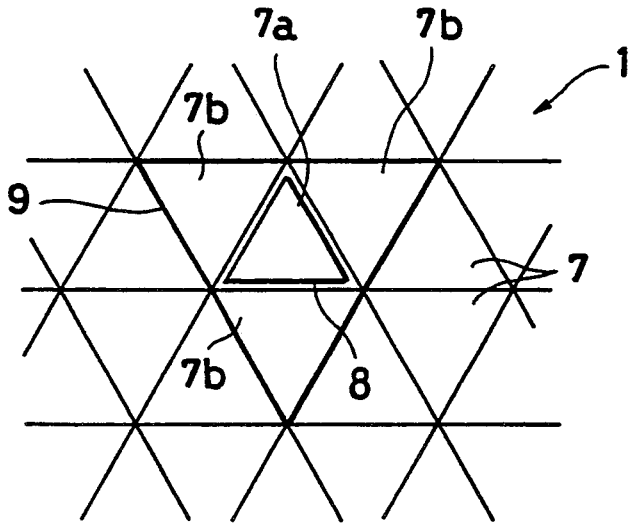
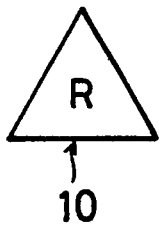
FIG. 3(a)
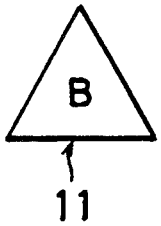
FIG. 3(b)
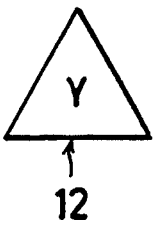
FIG. 3(c)

BOARD GAME

This application is a continuation of patent application Ser. No. 07/629,955 filed Dec. 19, 1990, now abandoned.

BACKGROUND OF THE INVENTION

1. Field of the Invention

The present invention relates to a board game in which three or more players play a game in which the players cause small pieces different in display from each other to rest, in order, on sections or divisions on a game board so as to surround the small pieces by pieces identical in appearance with each other.

2. Description of the Prior Art

A game known from Japanese Utility Model Publication No. 2691/1978, comprises a board having its surface having applied thereto a figure in which an interior of a triangle in the form of a substantially rectangular triangle is divided into a plurality of small triangular divisions which are similar to the aforesaid triangle and which are identical in size with each other, and at least two sets of small pieces which are suited for being disposed respectively on the divisions of the figure on the board. The two sets are different in color from each other, and each of the two sets has a plurality of small pieces. Suitable marks are applied to a division located at the central position of the triangle, and to divisions located between the central position and the corners.

The game disclosed in the above Japanese Utility Model Publication No. 2691/1978 is arranged as follows: the marks on the divisions indicate only the central position and the peripheral positions, and a game is played by game regulations similar to those of the game of go in which two players play the small pieces alternately on the divisions on the board one by one, one or more small pieces cut off in way out are removed from the surface of the board, and the way cut at each of the corners of the triangle is less by one path.

SUMMARY OF THE INVENTION

It is an object of the invention to provide a board game capable of being played by a novel game method which does not exist until now. The game is played by at least three players, and the game is played on the basis of game regulations with sets of small pieces different in display from each other rest, in order, on divisions of a game board so as to be surrounded by small pieces identical in display with each other, whereby a change is given to the arranging condition of the small pieces resting on the divisions. The division located substantially at the center, different from that of each of other divisions, plays a roll of a common small piece, in which the arrangement is such that, when a single division is emptied at a location between the plurality of small pieces resting on the divisions, the small piece must subsequently rest surely on the empty single division, in which the arrangement is such that, when two small pieces rest respectively on two divisions located at a corner of a hexagon so as to be in contact continuously with two adjacent sides, the two small pieces at the corner are not removed from the divisions, even if the two small pieces at the corner are surrounded by small pieces different in display from the small pieces at the corner.

A game according to a preferred embodiment of the invention comprises a game board in which a plurality of triangular divisions are defined within an interior of a hexagon having three pairs of parallel sides, by a plurality of straight lines equidistantly spaced from each other and extending in parallel to the three pairs of parallel sides of the hexagon, and in which a division located substantially at a center of the hexagon and three divisions located adjacent the first-mentioned division have applied thereto their respective displays, e.g., colors, which are different from those of other divisions, and at least three sets of pluralities of small pieces capable of resting respectively on the divisions of the game board, pieces of each of the at least three sets being different in display from those of the other sets.

Three or more sets of small pieces different in display from each other and capable of resting on the divisions rest, in order, respectively on and from three divisions, to which displays different from those of other divisions are applied, and which are located adjacent the substantially central division of the plurality of triangular divisions formed within the hexagon of the game board. When the small pieces resting respectively on the divisions and different in display from each other are surrounded by a plurality of small pieces identical in display with each other, the surrounded small pieces are removed from the divisions. The small pieces identical in display from the surrounding small pieces rest on the divisions from which the small pieces are removed. The division located substantially at the center of the hexagon and different in display from other divisions plays a roll of a common small piece.

Further, if a single division is vacated at a location among the plurality of small pieces resting on the divisions on the game board, the small piece must subsequently rest on the empty single division at the location between the two small pieces. If the small pieces rest on the two divisions located at the corner of the hexagon so as to be in contact continuously with the two adjacent sides, even if the two small pieces are surrounded by the small pieces different in display from the aforesaid two small pieces and identical in display with each other, the surrounded small pieces cannot be removed from the divisions. After all the divisions within the hexagon on the game board have been filled up by the small pieces, the winner is decided on the basis of the number of the small pieces.

BRIEF DESCRIPTION OF THE DRAWINGS

FIG. 2 is an enlarged top plan view of a principal portion in FIG. 1;

FIGS. 3(*a*), 3(*b*) and 3(*c*) are top plan views of small pieces to play the game. FIGS. 3(*d*), 3(*e*) and 3(*f*) are side elevation views of exemplary pieces bearing distinguishing letters, and FIGS. 3(*g*), 3(*h*) and 3(*i*) are side elevation views of exemplary pieces bearing distinguishing symbols;

DETAILED DESCRIPTION

Figure 1:
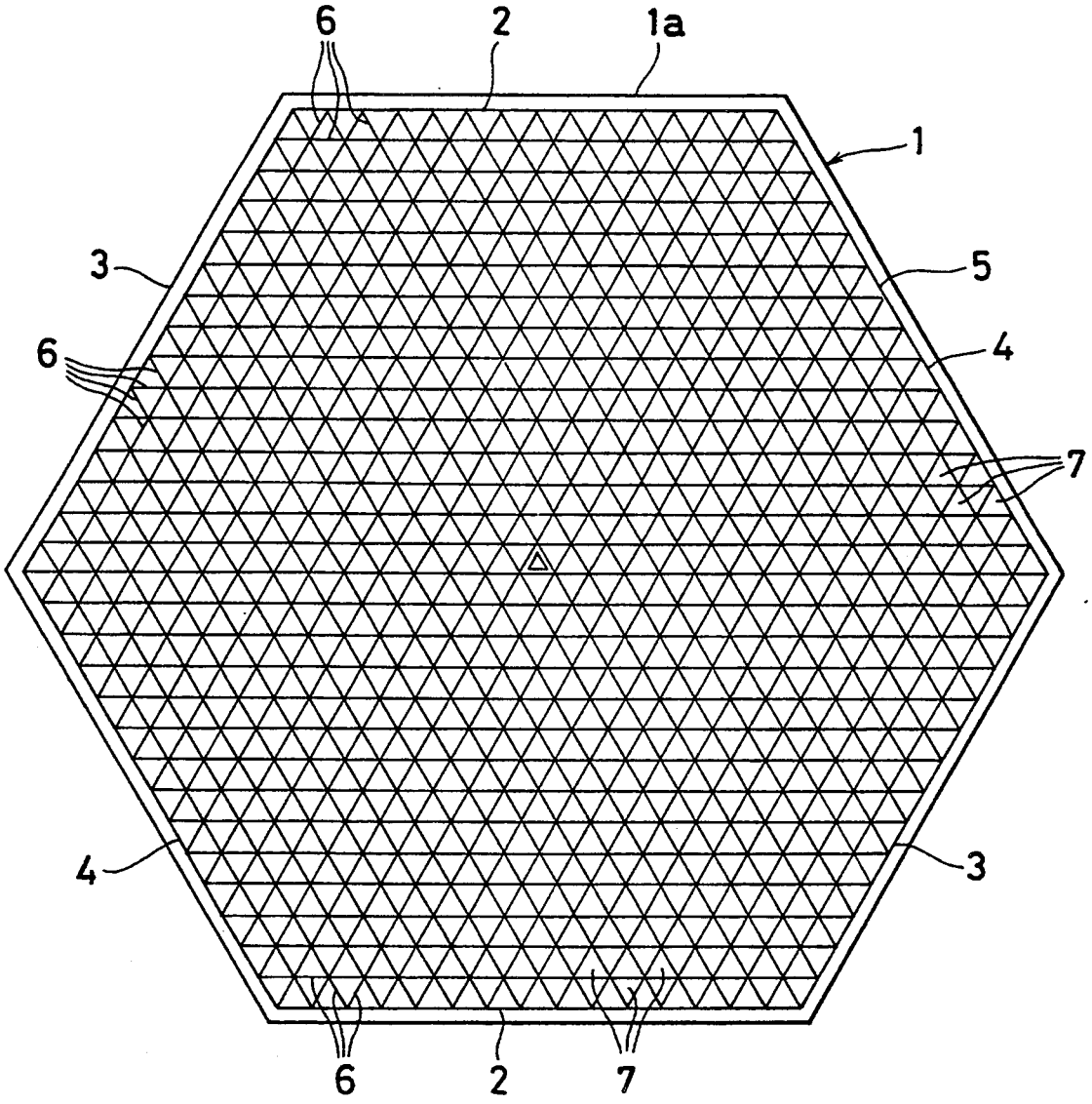
FIG. 1 is a top plan view of a game board according to an embodiment of the invention.
Figure 15:
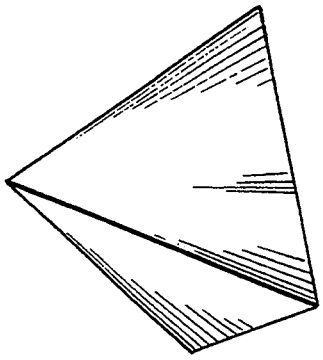
FIG. 15 is a perspective view of a typical triangular-conical shaped play piece.
Figure 14:
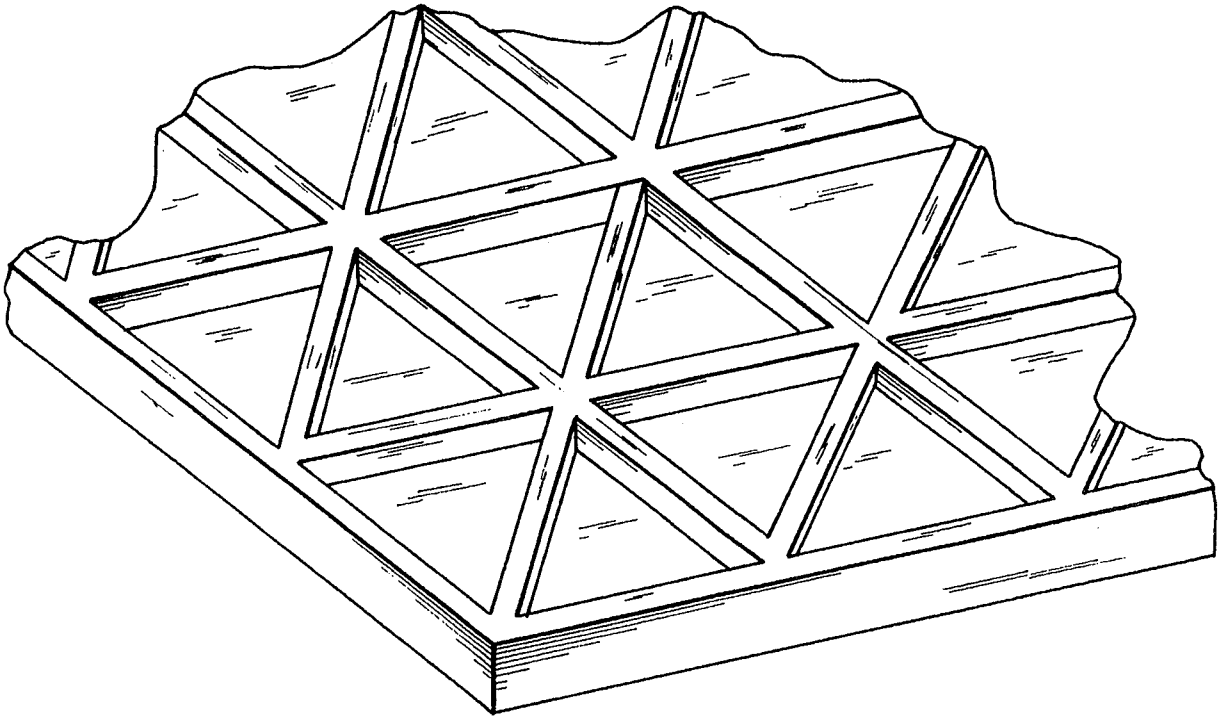
FIG. 14 is a partial perspective view of a portion of the game board in an embodiment in which the triangular spaces are recessed into the play surface of the game board.

Referring to FIG. 1, there is shown a game board 1 in the form of a hexagon, whose front face 1*a* is formed with a figure of a hexagon 5 which has three pairs of sides 2 and 2, 3 and 3 and 4 and 4, each pair of sides extending in parallel relation to each other. The hexagon 5 has its interior which is formed with a plurality of spaces or divisions 7 in the form of a regular triangle, by means of a plurality of straight lines 6 equidistantly spaced from each other and extending in parallel relation to the three pairs of sides 2 and 2, 3 and 3 and 4 and 4 of the hexagon 5. If the board is formed to have the triangular divisions slightly recessed into a play surface the term "spaces" may be regarded as more apt. In either case, the spaces or divisions are triangular and receive one play piece at a time. See FIGS. 14 and 15.

As shown in FIG. 2, a central space or division 7*a*, which is located substantially at a center of the hexagon 5, has an interior seen as a triangle 8 which has an appearance different from that of all the other divisions 7. A display of heavy or thick lines 9 different from other divisions 7 is applied to three divisions immediately adjacent the central division 7*a*.

The game board 1 is made of a material such as paper, wood, synthetic resinous material such as plastic or the like, or of metal material.

An angle defined between the side 2 and the side 3 of the hexagon 5 of the game board 1, an angle defined between the side 3 and the side 4, and an angle defined between the side 2 and the side 4 are respectively to 120° each . An angle defined between adjacent sides of each of the spaces or divisions 7 within the hexagon 5 of the game board 1 is 60°.

In connection with the above, it is possible that the configuration of the game board 1 may be chosen to be other than a hexagon. It is preferable that the number of the divisions 7 arranged along the sides 2, 3 and 4 of the hexagon 5 of the game board 1 is between 12 and 15. It is possible that the game board 1 is of collapsible type or of divisible type.

In connection with the above, the display or appearance which is applied to the substantially central division in the hexagon and the three divisions adjacent the central division and which is different from those of other divisions may be one other than the triangle or the heavy line. The triangular divisions formed within the hexagon of the game board may be made in the form of recesses. See FIGS. 14 and 15.

The boardgame comprises the game board, and three or more sets of pluralities of small pieces, i.e., game pieces, 10, 11 and 12 (refer to FIGS. 3(*a*), 3(*b*) and 3(*c*)) which are capable of resting on the divisions 7 of the game board 1 and which are different in display from each other set by set. FIGS. 3(*d*)–3(*f*) indicate how letters may be used to distinguish pieces of different sets, and FIGS. 3(*g*)–3(*i*) indicate a similar use of distinctive symbols to distinguish pieces of different sets.

As shown in FIGS. 3(*a*), 3(*b*) and 3(*c*), each of the small pieces 10, 11 and 12 of the game plaything are formed into a regular triangle which is identical in configuration with the divisions 7 of the game board 1. Colors different in display from each other are applied to front faces of the respective small pieces 10, 11 and 12. Specifically, display of red (denoted by R in the drawings) is applied to the front face of each of the small pieces 10. Display of blue (denoted by B in the drawings) is applied to the front face of each of the small pieces 11. Display of yellow (denoted by Y in the drawings) is applied to the front face of each of the small pieces 12. A plurality of small pieces 10, a plurality of small pieces 11 and a plurality of small pieces 12, whose respective numbers are ones required for playing the game, form their respective sets.

The small pieces 10, 11 and 12 are made of a material such as paper, wood, synthetic resinous material such plastic or the like, or of a metal material.

The division *7a*, which displays the triangle 8 and which is located substantially at the center of the hexagon 5 of the game board 1, plays a roll common to the displays of the respective small pieces 10, 11 and 12. The small pieces 10, 11 and 12 do not rest on the division *7a*.

In connection with the above, it will be sufficient that three or more sets of small pieces are prepared as a single set whose number corresponds to that of the divisions within the hexagon of the game board. It is also possible that the displays applied respectively to the front faces of the small pieces are differentiated from each other into colors other than red, blue and yellow. Alternatively, characters such as numerals, alphabets or the like, marks or symbols, or patterns or designs, which are different from each other set by set, may be applied respectively to the front faces of the small pieces. The configuration of each of the small pieces should be one capable of resting on the divisions of the game board. If the configuration of each of the small pieces is brought to a triangular cone, the small pieces can easily be held by fingers.

One game method of the embodiment will next be described.

The game regulations of the game are as follows:

(1) The players cause their small pieces to rest, in order, on the divisions 7 of the hexagon 5 on the game board 1 one by one.

(2) In the case where the players are three or more, they cause the small pieces to rest, in order, on and from the three divisions *7b* to which the display of the heavy line 9 is applied and which are located adjacent the division *7a* located substantially at the center of the hexagon 5 on the game board 1 and having its interior to which the display of the triangle 8 is applied.

(3) The small pieces rest, in order, on the empty divisions 7 on the game board 1 so as to be in contact with respective optional sides of the divisions 7 of the game board 1, on which the small pieces rest.

(4) If a small piece resting on the division *7b* adjacent the division *7a* is surrounded by two small pieces which are different in display from the small pieces on the divisions 7 adjacent the division *7b* and which are identical in display with each other, the division *7a* plays a roll similar to the small pieces of the two displays surrounded by the division *7a*, so that the three small pieces surround a small piece different in display from the three small pieces. Thus, the surrounded one small piece is removed from the division *7b*. One small piece identical in display with the surrounded small piece rests on the division *7b* after the one small piece has been removed from the division *7b*.

(5) If three sides of one small piece resting on the division 7 of the game board 1 are surrounded by three small pieces identical in display with each other but different in display from the first-mentioned one small piece, the surrounded small piece is removed from the division 7. A small piece identical in display with the surrounding three small pieces rests on the division 7 after the surrounded small piece has been removed therefrom.

(6) If sides of a plurality of small pieces resting respectively on the divisions 7 of the game board 1 are surrounded by a plurality of small pieces identical in display with each other but different in display from the first-mentioned small pieces, the plurality of surrounded small pieces are removed respectively from the divisions 7, and a plurality of small pieces identical in display with the surrounding small pieces rest on the divisions 7 after the plurality of small pieces have been removed therefrom.

(7) If one division 7 is emptied between two small pieces resting respectively on the divisions 7 of the game board 1, the subsequent player must surely cause the small piece to rest on the empty one division 7 between these two small pieces.

(8) If two sides of one small piece in contact with one of the sides 2, 3 and 4 of the hexagon 5 of the game board 1 is surrounded by two small pieces identical in display with each other but different in display from the aforesaid one small piece, the surrounded one small piece is removed from the division 7. One small piece identical in display with the surrounding small pieces rests on the division 7 after the aforementioned one small piece has been removed therefrom.

(9) Even if two small pieces 10, which rest respectively on two divisions 7 located at the corner of the hexagon 5 of the game board 1 so as to be in contact continuously with any two sides of the sides 2, 3 and 4 of the hexagon 5, are surrounded by two small pieces identical in display with each other but different in display from the first-mentioned two small pieces, it is impossible to remove the surrounded two small pieces respectively from the divisions 7.

(10) Even if a plurality of small pieces resting respectively on the divisions 7 of the game board 1 are surrounded by a plurality of small pieces identical in display with each other but different in display from the first-mentioned small pieces, it is impossible to remove the plurality of surrounded small pieces respectively from the divisions 7, if there is or are a empty division 7 or divisions 7 at the interior surrounded by small pieces identical in display with each other.

(11) If all the divisions 7 within the hexagon 5 of the game board 1 are filled up by the small pieces, the issue is decided on the basis of the number of a difference between the small pieces remaining at hand of the players and the small pieces removed from the divisions.

For example, in the case where three players play a game, a plurality of red small pieces 10, a plurality of blue small pieces 11 and a plurality of yellow small pieces 12 are first distributed respectively to the three players color by color. The order of the game is decided. The game starts.

Figure 4:
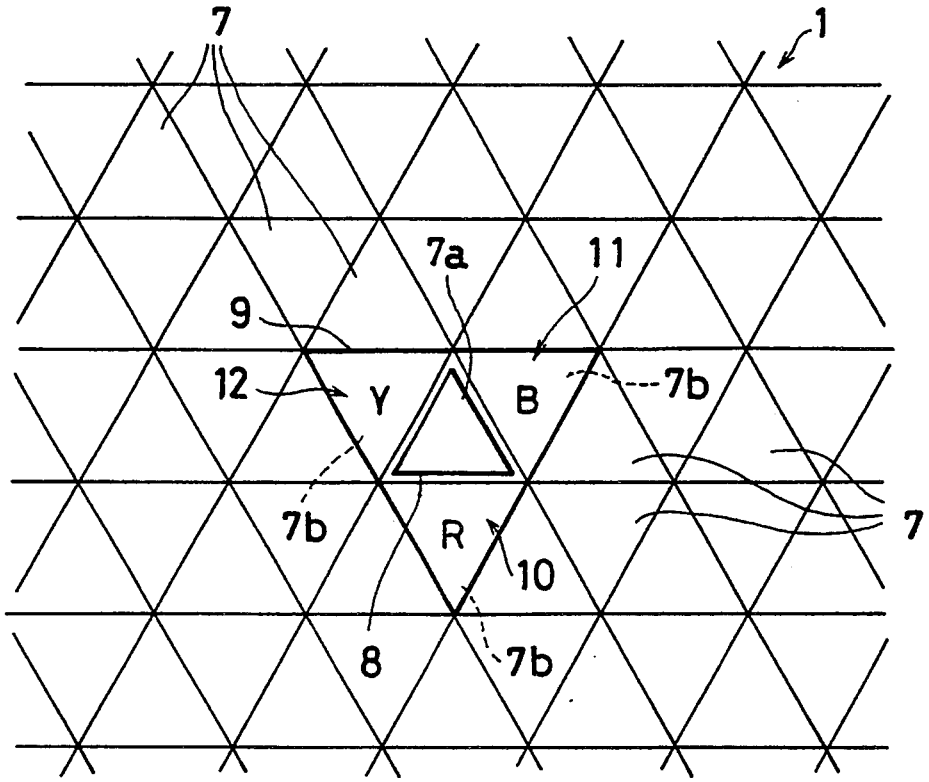
FIG. 4 is a fragmentary enlarged top plan view showing a resting condition of the small pieces different in display from each other, with respect to divisions on the game board in the case where a game is played by three players.

First, as shown in FIG. 4, the players cause one red small piece 10, one blue small piece 11 and one yellow small piece 12, which are different in display from each other, to rest, in order, respectively on three divisions 7*b* to which the display of the heavy line 9 is applied and which are located adjacent the division 7*a* which is located substantially at the center of the hexagon 5 of the game board 1 and which has its interior having applied thereto the display of the triangle 8. After the division 7*a* has been surrounded by the three small pieces 10, 11 and 12, the players cause the small pieces 10, 11 and 12 to rest, in order, on the empty divisions 7 so as to be in contact with one side of any optional one of the small pieces 10, 11 and 12 which rest respectively on the divisions.

Figure 5A:
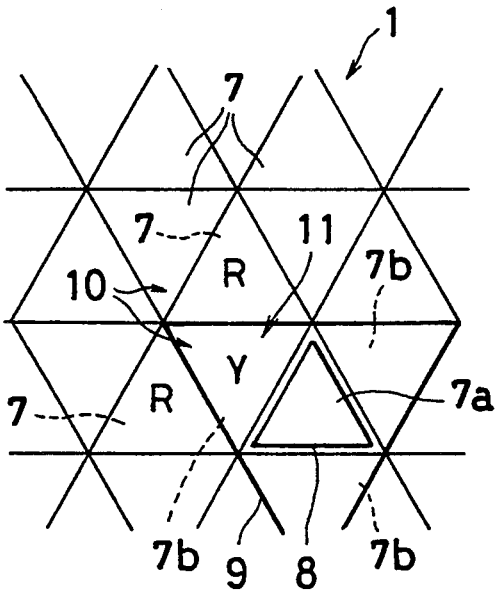
FIG. 5*a* is a fragmentary enlarged top plan view showing a condition in which a single small piece is surrounded by two small pieces different in display from the single small piece and identical in display with each other, and a central division different in display from the single small piece.
Figure 5B:
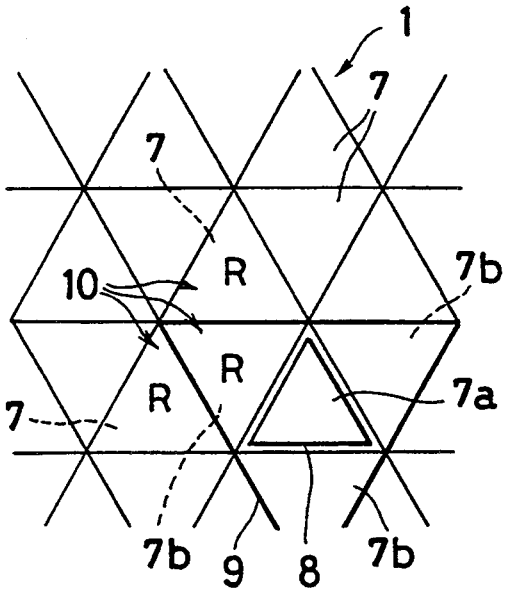
FIG. 5*b* is a fragmentary enlarged top plan view showing a condition in which the surrounded single small piece illustrated in FIG. 5*a* is removed and is replaced by a small piece identical in display with the surrounding small pieces.

As shown in FIG. 5*a*, if two sides of one yellow small piece 12, which rests on the division 7*b* adjacent the division 7*a* which is located substantially at the center of the hexagon 5 of the game board 1 and which has its interior having applied thereto the display of the triangle 8, are surrounded by two red small pieces 10, the division 7*a* plays a roll similar to the red small pieces 10 surrounding the yellow small piece 12. Thus, three red small pieces 10 surround one yellow small piece 12. The surrounded yellow small piece 12 is removed from the division 7*b*. As shown in FIG. 5*b*, one red small piece 10 rests on the division 7*b* after the yellow small piece 12 has been removed therefrom.

Figure 6A:
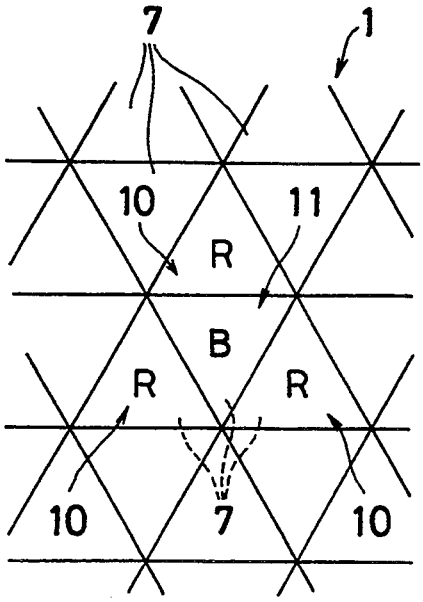
FIG. 6*a* is a fragmentary enlarged top plan view showing a condition in which a single small piece is surrounded by three small pieces different in display from the single small piece and identical in display with each other.
Figure 6B:
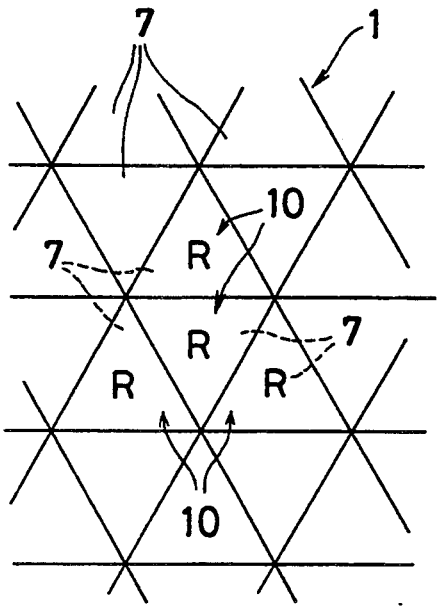
FIG. 6*b* is a fragmentary enlarged top plan view showing a condition in which the surrounded single small piece illustrated in FIG. 6*a* is removed and is replaced with a small piece identical in display with the surrounding small pieces.

As shown in FIG. 6*a*, three sides of one blue small piece 11 resting on the division 7 of the game board 1 are surrounded by three red small pieces 10, the blue small piece 11 is removed from the division 7. As shown in FIG. 6*b*, one red small piece 10 rests on the division 7 after the blue small piece 11 has been removed therefrom.

Figure 7A:
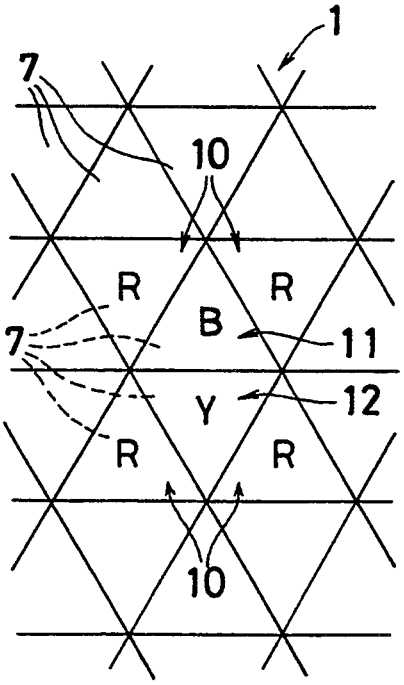
FIG. 7*a* is a view for explanation of a condition in which two small pieces different in display from each other are surrounded by four small pieces identical in display with each other.
Figure 7B:
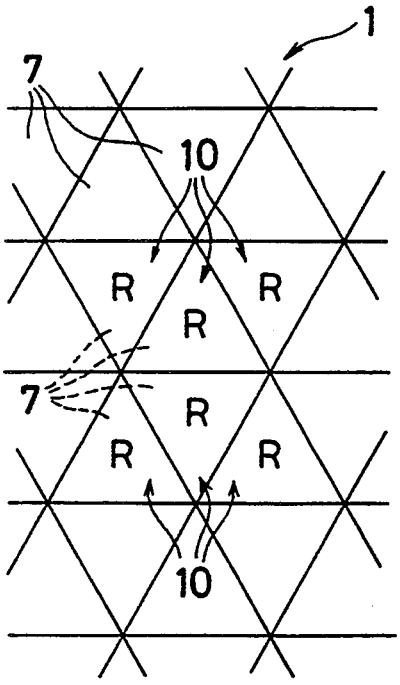
FIG. 7*b* is a fragmentary enlarged top plan view showing a condition in which the surrounded two small pieces illustrated in FIG. 7*a* are removed and are replaced by small pieces identical in display with the surrounding small pieces.

As shown in FIG. 7*a*, four sides of the blue small piece 11 and the yellow small piece 12, which rest respectively on the divisions 7 of the game board 1 and which are located adjacent each other, are surrounded by four red small pieces 10, the blue small piece 11 and the yellow small piece 12 are removed respectively from the divisions 7. As shown in FIG. 7*b*, two red small pieces 10 rest respectively on the divisions 7 after the blue small piece 11 and the yellow small piece 12 have been removed therefrom.

Figure 8A:
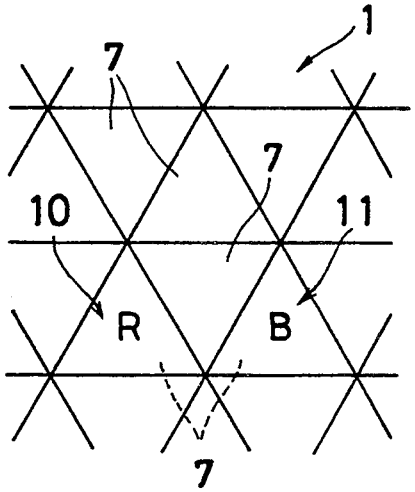
FIG. 8*a* is a fragmentary enlarged top plan view showing a condition in which a single division is emptied between two small pieces which are different in display from each other.
Figure 8B:
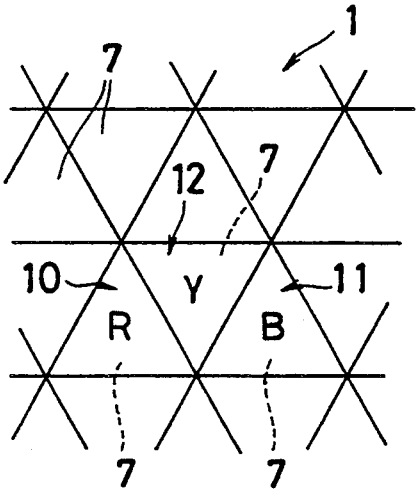
FIG. 8*b* is a fragmentary enlarged top plan view showing a condition in which a single small piece different in display from the two small pieces different in display from each other illustrated in FIG. 8*a* rests on a division between the two small pieces.

As shown in FIG. 8*a*, if one division 7 is emptied at a location between the red small piece 10 and the blue small piece 11, which rest respectively on the divisions 7 of the game board 1, the subsequent player (i.e., the one playing the yellow pieces) must cause the yellow small piece 12 to rest on the one division 7 located between the red small piece 10 and the blue small piece 11, as shown in FIG. 8*b*.

Figure 9A:
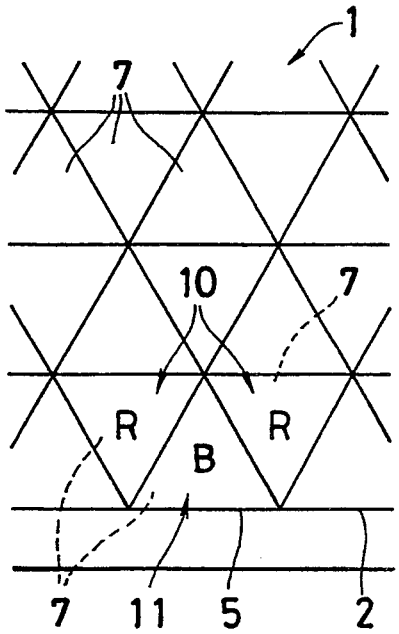
FIG. 9*a* is a fragmentary enlarged top plan view showing a condition in which a single small piece in contact with the side of the hexagon is surrounded by two small pieces different in display from the single small piece and identical in display with each other.
Figure 9B:
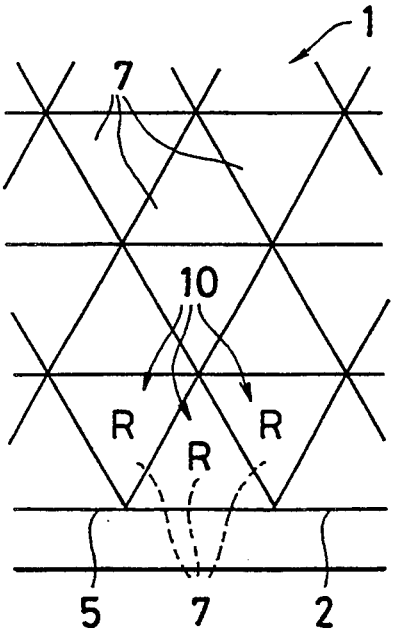
FIG. 9*b* is a fragmentary enlarged top plan view showing a condition in which the surrounded single small piece illustrated in FIG. 9*a* is removed and is replaced by a small piece identical in display with the surrounding small pieces.

As shown in FIG. 9*a*, if two sides of the blue small piece 11, which is in contact with the side 2 of the hexagon 5 of the game board 1, are surrounded by two red small pieces 10, the blue small piece 11 is removed from the division 7. As shown in FIG. 9*b*, a red small piece 10 rests on the division 7 after the blue small piece 11 has been removed therefrom.

Figure 10:
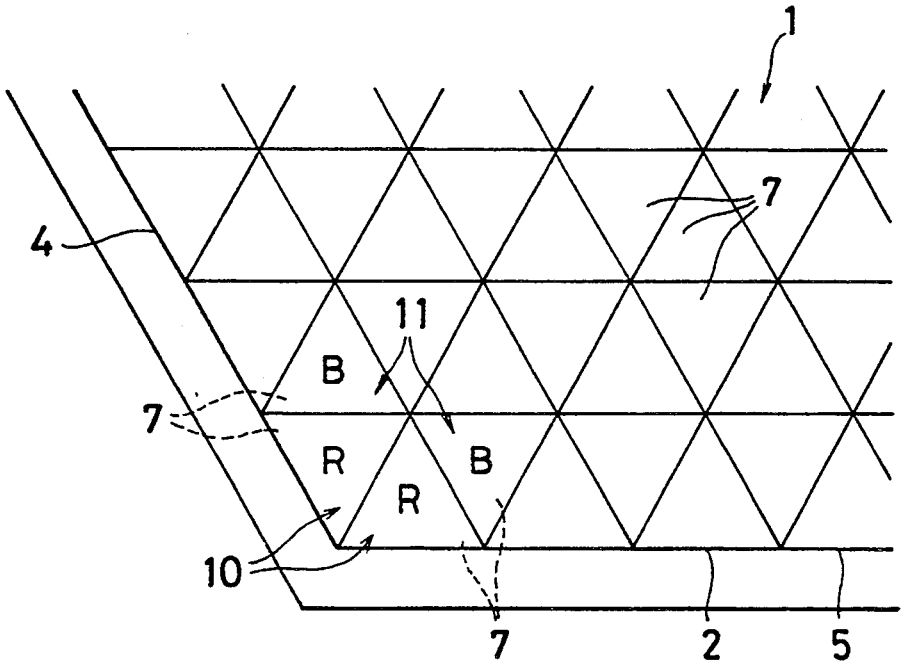
FIG. 10 is a fragmentary enlarged top plan view showing a condition in which two small pieces identical in display with each other and located on the divisions at the corner of the hexagon are surrounded by two small pieces different in display from the first-mentioned small pieces and identical in display with each other.

As shown in FIG. 10, if two red small pieces 10 resting respectively on two divisions 7 located at the corner of the hexagon 5 of the game board 1 are in contact continuously with the side 2 and the side 4 of the hexagon 5, the two red small pieces 10 cannot be removed respectively from the divisions 7, even if the two red small pieces 10 are surrounded by two blue small pieces 11.

Figure 11:
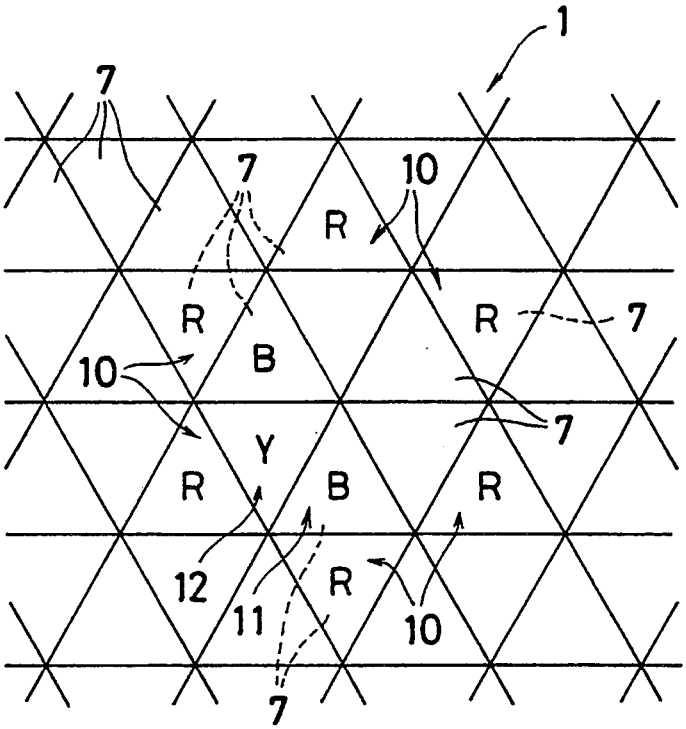
FIG. 11 is a fragmentary enlarged top plan view showing a condition in which a plurality of small pieces different in display from each other and empty divisions are surrounded by a plurality of small pieces identical in display with each other.

As shown in FIG. 11, even if six red small pieces 10 resting respectively on the divisions 7 of the game board 1 surround two blue small pieces 11 and one yellow small piece 12, the blue small pieces 11 and the yellow small piece 12 cannot be removed respectively from the divisions 7, if there is or are an empty division 7 or divisions 7 within the interior surrounded by the red small pieces 10.

Figure 12:
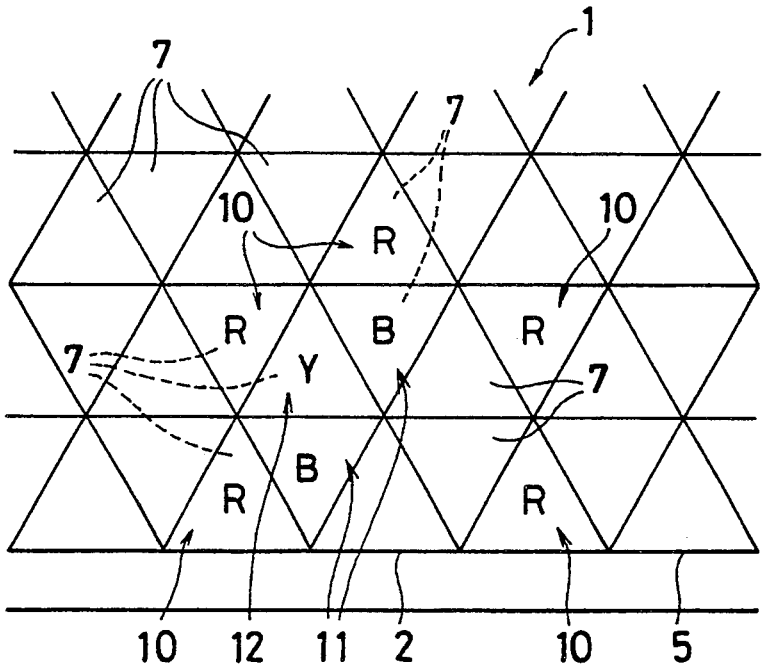
FIG. 12 is a fragmentary enlarged top plan view showing a condition in which a plurality of small pieces different in display from each other and empty divisions are surrounded by two small pieces in contact with the side of the hexagon and identical in display with each other and three small pieces resting respectively on divisions.

As shown in FIG. 12, even if two red small pieces in contact with the side 2 of the game board 1 and three red small pieces 10 resting respectively on the divisions 7 surround two blue small pieces 11 and one yellow small piece 12, the blue small pieces 11 and the yellow small piece 12 cannot be removed respectively from the divisions 7, if there is or are an empty division 7 or divisions 7 within the interior surrounded by the red small pieces 10.

After all the divisions 7 within the hexagon 5 of the game board 1 have been filled up by the small pieces 10, 11 and 12, the issue is decided on the basis of the number of a difference between the small pieces remaining at hand of the players and the small pieces removed from the divisions.

Figure 13:
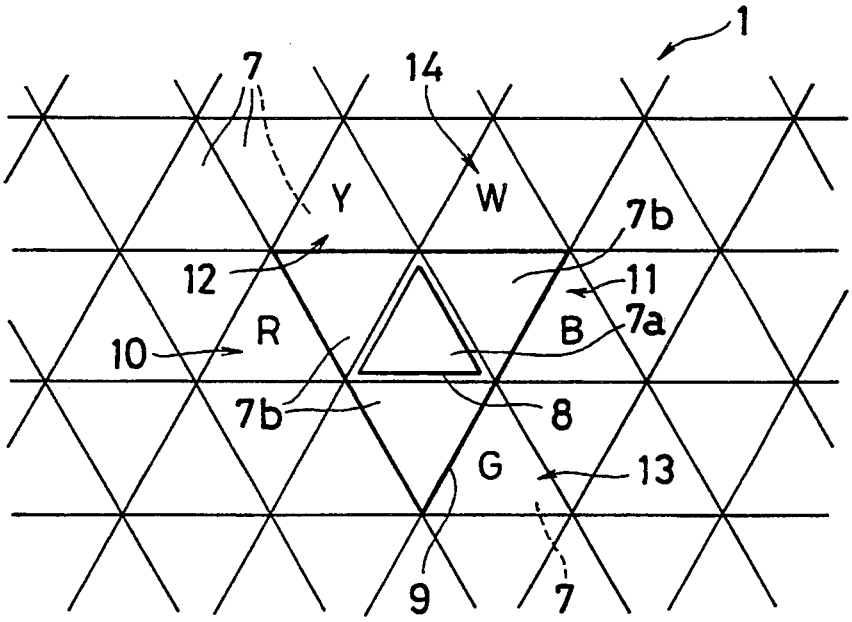
FIG. 13 is a fragmentary enlarged top plan view in the case where a game is played by four or more players.

In the case where a game is played by four or more players, as shown in FIG. 13, the players cause small pieces different in display from each other, for example, red small piece 10, blue small pieces 11, yellow small pieces 12, small pieces 13 having their respective front faces having applied thereto green displays (denoted by G in the drawing), and small pieces 14 having their respective front faces having applied thereto white displays (denotes by W in the drawing), to rest, in order, on divisions 7 adjacent the outside of three divisions 7*b* which have applied thereto the display of the heavy line 9, which are located adjacent the division 7*a* located substantially at the center of the hexagon 5 of the game board 1 and which have their interior having applied thereto the display of the triangle 8.

In this case, the divisions having applied thereto the display of the heavy line 9 are utilized as colors advantageous or favorable to the players themselves.

In connection with the above, if another triangle different in display is applied to the interior of the hexagon of the game board, it is also possible to play a game on the basis of another game regulations.

What is claimed is:

1. A method for playing a game, comprising the steps of:

providing a game board in which a triangular non-playable central space and a plurality of playable triangular spaces therearound are defined within an interior of a hexagon having three pairs of parallel sides, said triangular non-playable and playable spaces being defined by three pluralities of straight lines spaced equidistantly from each other and respectively extending parallel to corresponding ones of the three pairs of parallel sides of the hexagon, wherein the triangular non-playable central space is provided a distinctive appearance to identify it as a space upon which a play piece is not to be placed during play and is located substantially at the center of the board and three triangular center-adjacent playable spaces are located immediately adjoining said central space, the center-adjacent playable spaces being defined by lines that are thicker than lines defining all other triangular spaces;

providing each of three players with one of three mutually distinguishable sets of pluralities of play pieces each shaped and sized to be placed on the triangular playable spaces of the game board, the total number of play pieces of all three sets taken together being equal to the total number of playable spaces;

placing of a respective play piece, by each of at least two players playing in a selected order on a different one of the three center-adjacent playable spaces;

placing of respective play pieces on one of then available unoccupied playable spaces immediately adjacent to one of then occupied playable spaces, by each player in accordance with said selected order; and playing of respective pieces by the players in said selected order in accordance with rules requiring that when two of the playable spaces adjacent one of the then occupied center-adjacent spaces are occupied by play pieces of a player different from that of the player whose one play piece is occupying said then occupied center-adjacent playable space, said occupying one play piece is removed and is replaced by a play piece of the different player who played said two play pieces earlier, when a particular player's play piece is occupying a particular playable space, and another player's play pieces are placed on playable spaces immediately surrounding that particular playable space, the play piece on the surrounded playable space is replaced by a play piece from the same set of play pieces as the surrounding play pieces, when a first plurality of play pieces is surrounded by a second plurality of play pieces all of which belong to another player, the surrounded play pieces are removed and are replaced by a corresponding number of play pieces that are of the same set as the surrounding play pieces, when one playable space between two playable spaces is unoccupied, the next player to play in said order must place his play piece on said unoccupied playable space, when play pieces of a particular player surround a plurality of playable spaces but there is an unoccupied playable space among the surrounded playable spaces, then none of the surrounded play pieces may be replaced, no player placing a play piece on the non-playable central space at any time during the play of the game, and when all available playable spaces on the hexagon are occupied by said play pieces, the winner of the game is declared on the basis of a numerical difference between the number of play pieces available to each of the players for play as compared to each player's play pieces removed from the board.

2. The method according to claim 1, further comprising the step of:

forming the game board so that it is collapsible.

3. The method according to claim 1, further comprising the step of:

forming the game board so that it is divisible.

4. The method according to claim 1, further comprising the step of:

forming the game board so that all of the triangular spaces defined thereon are formed as recesses.

5. The method according to claim 1, further comprising the step of:

providing the play pieces in each of said three mutually distinguishable pluralities of play pieces with distinguishing symbols, so that the play pieces played by each player are readily distinguishable from play pieces played by each of the other players.

6. The method according to claim 1, further comprising the step of:

providing the play pieces in each of said three mutually distinguishable pluralities of play pieces with a distinguishing color, so that the play pieces played by each player are readily distinguishable from play pieces played by each of the other players.

7. The method according to claim 1, wherein:

in the step of playing respective pieces by the players, when a play piece of said particular player is placed on a particular triangular playable space having a side along an edge of said board, and two play pieces each belonging to another player are placed on playable spaces immediately adjacent the other two sides of said particular playable space, the play piece of said particular player is removed and is replaced by a play piece of said another player.

8. The method according to claim 1, wherein:

in the step of playing respective pieces by the players, when two play pieces of said particular player are placed on two playable spaces which together define a corner of said board and two play pieces of another player are placed on playable spaces immediately adjoining said two playable spaces the two play pieces of said particular player are not to be removed.

9. The method according to claim 1, wherein:

in the step of playing respective pieces by the players, when a first plurality of play pieces all of said particular player occupy a plurality of playable spaces so as to surround at least one unoccupied playable space and said first plurality of play pieces is surrounded by a second plurality of small pieces all of another player, none of said first plurality of play pieces are to be removed from the board.

* * * * *